US009464569B2

(12) United States Patent
Sturman

(10) Patent No.: US 9,464,569 B2
(45) **Date of Patent: *Oct. 11, 2016**

(54) DIGITAL HYDRAULIC OPPOSED FREE PISTON ENGINES AND METHODS

(75) Inventor: Oded Eddie Sturman, Woodland Park, CO (US)

(73) Assignee: Sturman Digital Systems, LLC, Woodland Park, CO (US)

( * ) Notice: Subject to any disclaimer, the term of this patent is extended or adjusted under 35 U.S.C. 154(b) by 102 days.

This patent is subject to a terminal disclaimer.

(21) Appl. No.: 13/554,123

(22) Filed: Jul. 20, 2012

(65) Prior Publication Data

US 2013/0025570 A1 Jan. 31, 2013

Related U.S. Application Data

(60) Provisional application No. 61/513,363, filed on Jul. 29, 2011.

(51) Int. Cl.
*F02B 71/00* (2006.01)
*F02B 71/04* (2006.01)

(52) U.S. Cl.
CPC ..... *F02B 71/045* (2013.01)

(58) Field of Classification Search
USPC ..... 123/53.3, 53.6, 55.7, 46 R; 417/11, 159, 417/364, 380, 269, 270, 271, 505, 34, 279, 417/313, 317, 539, 559
See application file for complete search history.

(56) References Cited

U.S. PATENT DOCUMENTS 1,062,999 A 5/1913 Webb
2,058,705 A 10/1936 Maniscalco
2,661,592 A 12/1953 Bright
2,902,207 A 9/1959 Burion
3,065,703 A 11/1962 Harman
3,170,406 A 2/1965 Robertson (Continued)

FOREIGN PATENT DOCUMENTS

CN 101225765 7/2008
CN 101495730 7/2009

(Continued)

OTHER PUBLICATIONS

"Office Action Dated Feb. 28, 2014; U.S. Appl. No. 13/181,437", (Feb. 28, 2014).

(Continued)

*Primary Examiner* — Hung Q Nguyen
*Assistant Examiner* — Ruben Picon-Feliciano
(74) *Attorney, Agent, or Firm* — Blakely Sokoloff Taylor & Zafman LLP

(57) ABSTRACT

Digital hydraulic opposed free piston internal combustion engines having a pair of free pistons in a pair of cylinders defining a combustion chamber above each free piston. The pair of free pistons is arranged to move within the pair of cylinders with parallel axes of free piston motion, and preferably co-linear axes of free piston motion. At least one hydraulic plunger is under each free piston with each hydraulic plunger in a respective hydraulic cylinder. The hydraulic cylinders are coupled to electronically controlled hydraulic cylinder valving. A controller controls the electronically controlled hydraulic cylinder valving to control the pair of free pistons to have substantially equal and opposite motions.

22 Claims, 4 Drawing Sheets

(56) References Cited

U.S. PATENT DOCUMENTS 3,209,737 A 10/1965 Omotehara et al.
3,532,121 A 10/1970 Sturman et al.
3,623,463 A 11/1971 De Vries
3,683,239 A 8/1972 Sturman
3,743,898 A 7/1973 Sturman
3,859,966 A 1/1975 Braun
3,931,845 A 1/1976 Dixon
3,952,710 A 4/1976 Kawarada et al.
3,995,974 A 12/1976 Herron
4,009,695 A 3/1977 Ule
4,097,198 A 6/1978 Herron
4,162,662 A 7/1979 Melchior
4,192,265 A 3/1980 Amano
4,312,038 A 1/1982 Imai et al.
4,326,380 A 4/1982 Rittmaster et al.
4,333,424 A 6/1982 McFee
4,396,037 A 8/1983 Wilcox
4,403,474 A 9/1983 Ruthven
4,409,638 A 10/1983 Sturman et al.
4,435,133 A 3/1984 Meulendyk
RE32,163 E 5/1986 Tokuda et al.
4,599,861 A 7/1986 Beaumont
4,779,582 A 10/1988 Lequesne
4,783,966 A 11/1988 Aldrich
4,887,562 A 12/1989 Wakeman
4,906,924 A 3/1990 Zannis
4,930,464 A 6/1990 Letsche
5,003,937 A 4/1991 Matsumoto et al.
5,022,358 A 6/1991 Richeson
5,121,730 A 6/1992 Ausman et al.
5,124,598 A 6/1992 Kawamura
5,170,755 A 12/1992 Kano et al.
5,193,495 A 3/1993 Wood, III
5,209,453 A 5/1993 Aota et al.
5,224,683 A 7/1993 Richeson
5,237,968 A 8/1993 Miller et al.
5,237,976 A 8/1993 Lawrence et al.
5,248,123 A 9/1993 Richeson et al.
5,255,641 A 10/1993 Schechter
5,275,134 A 1/1994 Springer
5,275,136 A 1/1994 Schechter et al.
5,327,856 A 7/1994 Schroeder et al.
5,331,277 A 7/1994 Burreson
5,335,633 A 8/1994 Thien
5,339,777 A 8/1994 Cannon
5,363,651 A 11/1994 Knight
5,367,990 A 11/1994 Schechter
5,373,817 A 12/1994 Schechter et al.
5,408,975 A 4/1995 Blakeslee et al.
5,410,994 A 5/1995 Schechter
5,419,286 A 5/1995 Edison et al.
5,419,492 A 5/1995 Gant et al.
5,421,521 A 6/1995 Gibson et al.
5,448,973 A 9/1995 Meyer
5,460,329 A 10/1995 Sturman
5,463,996 A 11/1995 Maley et al.
5,471,959 A 12/1995 Sturman
5,473,893 A 12/1995 Achten et al.
5,482,445 A 1/1996 Achten et al.
5,494,219 A 2/1996 Maley et al.
5,499,605 A 3/1996 Thring
5,507,316 A 4/1996 Meyer
5,526,778 A 6/1996 Springer
5,540,193 A 7/1996 Achten et al.
5,546,897 A 8/1996 Brackett
5,551,398 A 9/1996 Gibson et al.
5,556,262 A 9/1996 Achten et al.
5,572,961 A 11/1996 Schechter et al.
5,577,468 A 11/1996 Weber
5,598,871 A 2/1997 Sturman et al.
5,622,152 A 4/1997 Ishida
5,628,293 A 5/1997 Gibson et al.
5,638,781 A 6/1997 Sturman
5,640,987 A 6/1997 Sturman
5,647,734 A 7/1997 Milleron
5,669,355 A 9/1997 Gibson et al.
5,673,669 A 10/1997 Maley et al.
5,682,858 A 11/1997 Chen et al.
5,687,693 A 11/1997 Chen et al.
5,697,342 A 12/1997 Anderson et al.
5,700,136 A 12/1997 Sturman
5,713,316 A 2/1998 Sturman
5,720,261 A 2/1998 Sturman et al.
5,732,677 A 3/1998 Baca
5,738,075 A 4/1998 Chen et al.
5,752,659 A 5/1998 Moncelle
5,813,841 A 9/1998 Sturman
5,829,393 A 11/1998 Achten et al.
5,829,396 A 11/1998 Sturman
5,857,436 A 1/1999 Chen
5,873,526 A 2/1999 Cooke
5,894,730 A 4/1999 Mitchell
5,937,799 A 8/1999 Binion
5,954,030 A 9/1999 Sturman et al.
5,960,753 A 10/1999 Sturman
5,970,956 A 10/1999 Sturman
5,979,803 A 11/1999 Peters et al.
5,983,638 A 11/1999 Achten et al.
6,005,763 A 12/1999 North
6,012,430 A 1/2000 Cooke
6,012,644 A 1/2000 Sturman et al.
6,085,991 A 7/2000 Sturman
6,105,616 A 8/2000 Sturman et al.
6,109,284 A 8/2000 Johnson et al.
6,135,069 A * 10/2000 Fenelon et al. ..... 123/46 R
6,148,778 A 11/2000 Sturman
6,152,091 A 11/2000 Bailey et al.
6,158,401 A 12/2000 Bailey
6,161,770 A 12/2000 Sturman
6,170,442 B1 1/2001 Beale
6,173,685 B1 1/2001 Sturman
6,206,656 B1 3/2001 Bailey et al.
6,257,499 B1 7/2001 Sturman
6,269,783 B1 8/2001 Bailey
6,279,517 B1 8/2001 Achten
6,308,690 B1 10/2001 Sturman
6,314,924 B1 11/2001 Berlinger
6,360,728 B1 3/2002 Sturman
6,412,706 B1 7/2002 Guerrassi et al.
6,415,749 B1 7/2002 Sturman et al.
6,463,895 B2 10/2002 Bailey
6,497,216 B2 12/2002 Gaessler et al.
6,543,411 B2 4/2003 Raab et al.
6,551,076 B2 4/2003 Boulware
6,557,506 B2 5/2003 Sturman
6,575,126 B2 6/2003 Sturman
6,575,384 B2 6/2003 Ricco
6,592,050 B2 7/2003 Boecking
6,655,355 B2 12/2003 Kropp et al.
6,684,856 B2 2/2004 Tanabe et al.
6,684,857 B2 2/2004 Boecking
6,739,293 B2 5/2004 Turner et al.
6,769,405 B2 8/2004 Leman et al.
6,863,507 B1 3/2005 Schaeffer et al.
6,910,462 B2 6/2005 Sun et al.
6,910,463 B2 6/2005 Oshizawa et al.
6,925,971 B1 8/2005 Peng et al.
6,931,845 B2 8/2005 Schaeffer
6,948,459 B1 9/2005 Laumen et al.
6,951,204 B2 10/2005 Shafer et al.
6,951,211 B2 10/2005 Bryant
6,953,010 B1 10/2005 Hofbauer
6,957,632 B1 10/2005 Carlson
6,971,341 B1 12/2005 Fuqua et al.
6,983,724 B2 * 1/2006 Carlson ..... 123/46 R
6,994,077 B2 2/2006 Kobayashi et al.
6,999,869 B1 2/2006 Gitlin et al.
7,025,326 B2 4/2006 Lammert et al.
7,032,548 B2 4/2006 Tusinean
7,032,574 B2 4/2006 Sturman
7,108,200 B2 9/2006 Sturman
7,128,062 B2 10/2006 Kuo et al.
7,182,068 B1 2/2007 Sturman et al.
7,258,086 B2 8/2007 Fitzgerald

(56) References Cited

U.S. PATENT DOCUMENTS

| | | | |
|---|---|---|---|
| 7,341,028 | B2 | 3/2008 | Klose et al. |
| 7,353,786 | B2 | 4/2008 | Scuderi et al. |
| 7,387,095 | B2 | 6/2008 | Babbitt et al. |
| 7,412,969 | B2 | 8/2008 | Pena et al. |
| 7,481,039 | B2 | 1/2009 | Surnilla et al. |
| 7,568,632 | B2 | 8/2009 | Sturman |
| 7,568,633 | B2 | 8/2009 | Sturman |
| 7,694,891 | B2 | 4/2010 | Sturman |
| 7,717,359 | B2 | 5/2010 | Sturman |
| 7,730,858 | B2 | 6/2010 | Babbitt et al. |
| 7,793,638 | B2 | 9/2010 | Sturman |
| 7,954,472 | B1 | 6/2011 | Sturman |
| 7,958,864 | B2 | 6/2011 | Sturman |
| 8,196,844 | B2 | 6/2012 | Kiss et al. |
| 8,276,550 | B1 | 10/2012 | Noguchi et al. |
| 8,282,020 | B2 | 10/2012 | Kiss et al. |
| 8,327,831 | B2 | 12/2012 | Sturman |
| 8,342,153 | B2 | 1/2013 | Sturman |
| 8,499,728 | B2 | 8/2013 | Xie et al. |
| 8,549,854 | B2 | 10/2013 | Dion et al. |
| 8,596,230 | B2 * | 12/2013 | Sturman et al. ..... 123/46 R |
| 8,887,690 | B1 | 11/2014 | Sturman |
| 2001/0017123 | A1 | 8/2001 | Raab et al. |
| 2001/0020453 | A1 | 9/2001 | Bailey |
| 2002/0017573 | A1 | 2/2002 | Sturman |
| 2002/0073703 | A1 | 6/2002 | Bailey |
| 2002/0076339 | A1 | 6/2002 | Boulware |
| 2002/0166515 | A1 | 11/2002 | Ancimer et al. |
| 2003/0015155 | A1 | 1/2003 | Turner et al. |
| 2003/0041593 | A1 | 3/2003 | Yoshida et al. |
| 2003/0226351 | A1 | 12/2003 | Glenn |
| 2004/0045536 | A1 | 3/2004 | Hafner et al. |
| 2004/0177837 | A1 | 9/2004 | Bryant |
| 2005/0098162 | A1 | 5/2005 | Bryant |
| 2005/0247273 | A1 | 11/2005 | Carlson |
| 2006/0032940 | A1 | 2/2006 | Boecking |
| 2006/0042575 | A1 * | 3/2006 | Schmuecker et al. ..... 123/46 R |
| 2006/0192028 | A1 | 8/2006 | Kiss |
| 2006/0243253 | A1 | 11/2006 | Knight |
| 2007/0007362 | A1 | 1/2007 | Sturman |
| 2007/0113906 | A1 | 5/2007 | Sturman et al. |
| 2007/0245982 | A1 | 10/2007 | Sturman |
| 2008/0092860 | A2 | 4/2008 | Bryant |
| 2008/0264393 | A1 | 10/2008 | Sturman |
| 2008/0275621 | A1 | 11/2008 | Kobayashi |
| 2009/0037085 | A1 | 2/2009 | Kojima |
| 2009/0183699 | A1 | 7/2009 | Sturman |
| 2009/0199789 | A1 | 8/2009 | Beard |
| 2009/0199819 | A1 | 8/2009 | Sturman |
| 2009/0250035 | A1 | 10/2009 | Washko |
| 2009/0271088 | A1 | 10/2009 | Langham |
| 2010/0012745 | A1 | 1/2010 | Sturman |
| 2010/0186716 | A1 | 7/2010 | Sturman |
| 2010/0229838 | A1 | 9/2010 | Sturman |
| 2010/0275884 | A1 | 11/2010 | Gray, Jr. |
| 2010/0277265 | A1 | 11/2010 | Sturman et al. |
| 2010/0288249 | A1 | 11/2010 | Sasaki et al. |
| 2010/0307432 | A1 | 12/2010 | Xie et al. |
| 2011/0011354 | A1 | 1/2011 | Dincer et al. |
| 2011/0083643 | A1 | 4/2011 | Sturman et al. |
| 2011/0163177 | A1 | 7/2011 | Kiss |
| 2012/0080110 | A1 | 4/2012 | Kiss et al. |

FOREIGN PATENT DOCUMENTS

| | | |
|---|---|---|
| DE | 37 27 335 | 2/1988 |
| DE | 4024591 | 2/1992 |
| DE | 10239110 | 3/2004 |
| FR | 2901846 | 12/2007 |
| GB | 941453 | 11/1963 |
| GB | 2402169 | 12/2004 |
| JP | 60-035143 | 2/1985 |
| WO | WO-92/02730 | 2/1992 |
| WO | WO-93/10344 | 5/1993 |
| WO | WO-97/35104 | 9/1997 |
| WO | WO-98/11334 | 3/1998 |
| WO | WO-98/54450 | 12/1998 |
| WO | WO-01/46572 | 6/2001 |
| WO | WO-02/086297 | 10/2002 |
| WO | WO-2008/014399 | 1/2008 |

OTHER PUBLICATIONS

"International Search Report and Written Opinion of the International Searching Authority Dated Jan. 20, 2011", International Application No. PCT/US2010/052391.

"International Search Report and Written Opinion of the International Searching Authority Dated Jan. 31, 2013, International Application No. PCT/U52012/043393", (Jan. 31, 2013).

"Office Action Dated Apr. 12, 2013; U.S. Appl. No. 12/901,915", (Apr. 12, 2013).

"Office Action Dated Oct. 1, 2012, U.S. Appl. No. 12/901,915", (Oct. 1, 2012).

Alson, Jeff , et al., "Progress Report on Clean and Efficient Automotive Technologies Under Development at the EPA", *United States Environmental Protection Agency*, EPA420-R-04-002, (Jan. 2004), 198 pp total.

Anderson, Mark D., et al., "Adaptive Lift Control for a Camless Electrohydraulic Valvetrain", *SAE Paper No. 981029*, U. of Illinois and Ford Motor Co., (Feb. 23, 1998).

Blair, Gordon P., "Design and Simulation of Two-Stroke Engines", *SAE Publications No. R-161*, (1996), pp. 1-48.

Brueckner, Stephen , "Reducing Greenhouse Gas Emissions From Light-Duty Motor Vehicles", *California Air Resources Board (ARB) Workshop*, (Apr. 20, 2004), pp. 1-37.

Challen, Bernard , "Diesel Engine Reference Book Second Edition", *SAE Publication No. R-183*, (1999), pp. 27-71.

Cole, C. , et al., "Application of Digital Valve Technology to Diesel Fuel Injection", *SAE Paper No. 1999-01-0196*, Sturman Industries, Inc., (Mar. 1, 1999).

Dickey, Daniel W., et al., "NOx Control in Heavy-Duty Diesel Engines—What is the Limit?", *In-Cylinder Diesel Particulate and NOx Control*, SAE Publication No. SP-1326, (1998), pp. 9-20.

Duret, P. , "A New Generation of Two-Stroke Engines for the Year 2000", *A New Generation of Two-Stroke Engines for the Future?*, Paris, (1993), pp. 181-194.

Heisler, Heinz , "Vehicle and Engine Technology Second Edition", *SAE International*, London, (1999), pp. 292-308.

Kang, Kern Y., "Characteristics of Scavenging Flow in a Poppet-Valve Type 2-Stroke Diesel Engine by Using RSSV System", *Progress in Two-Stroke Engine and Emissions Control*, SAE Publication SP-1131, (1998), pp. 93-101.

Kang, Hyungsuk , et al., "Demonstration of Air-Power-Assist (APA) Engine Technology for Clean Combustion and Direct Energy Recovery in Heavy Duty Application", *SAE Technical Paper Series 2008-01-1197*, (Apr. 14-17, 2008), 9 pp.

Kim, Dean H., et al., "Dynamic Model of a Springless Electrohydraulic Valvetrain", *SAE Paper No. 970248*, U. of Illinois and Ford Research Company, (1997).

Misovec, Kathleen M., et al., "Digital Valve Technology Applied to the Control of an Hydraulic Valve Actuator", *SAE Paper No. 1999-01-0825*, Sturman Industries, Inc., (Mar. 1, 1999).

Nehmer, Daniel A., et al., "Development of a Fully Flexible Hydraulic Valve Actuation Engine, Part I: Hydraulic Valve Actuation System Development", *Proceedings of the 2002 Global Powertrain Congress (GPC) on Advanced Engine Design and Performance*, (2002), 12 pp total.

Nomura, K. , et al., "Development of a New Two-Stroke Engine with Poppet-Valves: Toyota S-2 Engine", *A New Generation of Two-Stroke Engines for the Future?*, (1993), pp. 53-62.

Nuti, Marco , et al., "Twenty Years of Piaggio Direct Injection Research to Mass Produced Solution for Small 2T SI Engines", *Two-Stroke Engines and Emissions*, SAE Publication SP-1327, (1998), pp. 65-78.

Osenga, Mike , "Cat's HEUI System: A Look at the Future?", *Diesel Progress*, (Apr. 1995), pp. 30-35.

(56) References Cited

OTHER PUBLICATIONS

Ricardo, Inc., "A Study of Potential Effectiveness of Carbon Dioxide Reducing Vehicle Technologies, Revised Final Report", *United States Environmental Protection Agency* EPA420-R-08-004A, EPA Contract No. EP-C-06-003, Work Assignment No. 1-14, (Jun. 2008), 126 pp total.
Schechter, Michael M., et al., "Camless Engine", *SAE Paper No. 960581*, Ford Research Lab, (Feb. 26, 1996).
Sheehan, John , et al., "An Overview of Biodiesel and Petroleum Diesel Life Cycles", A Joint Study Sponsored by: U.S. Department of Agriculture and U.S. Department of Energy, (May 1998), 60 pp total.
Sturman, Carol, et al., "Breakthrough in Digital Valves", *Machine Design*, (Feb. 21, 1994), pp. 37-42.
Vance, Evelyn , et al., "Advanced Fuel Injection System and Valve Train Technologies", SBIR Phase II Project Final Report, SBIR Contract No. W56HZV-07-C-0528, (Oct. 19, 2009), pp. 1-237.
Wilson, Rob , "Developments in Digital Valve Technology", *Diesel Progress North American Edition*, (Apr. 1997), pp. 76,78-79.
Wirbeleit, F. , et al., "Stratified Diesel Fuel-Water-Diesel Fuel Injection Combined with EGR—The Most Efficient In-Cylinder NOx and PM Reduction Technology", *Combustion and Emissions in Diesel Engines*, SAE Publication No. SP-1299, (1997), pp. 39-44.
Yamaguchi, T. , et al., "Improvements for Volumetric Efficiency and Emissions using Digital Hydraulic VVA in a High Boosting Diesel Engine", *THIESEL 2008 Conference on Thermo- and Fluid Dynamic Processes in Diesel Engines*, (2008), pp. 1-13.
"Office Action Dated Dec. 3, 2013; Chinese Patent Application No. 201080054641.5", (Dec. 3, 2013).
"Office Action Dated Feb. 3, 2014; U.S. Appl. No. 13/526,914", (Feb. 3, 2014).
"Notice of Allowance Mailed Jul. 16, 2013; U.S. Appl. No. 12/901,915", (Jul. 16, 2013).
"Office Action Dated Sep. 6, 2013; U.S. Appl. No. 13/526,914", (Sep. 6, 2013).
"International Search Report and Written Opinion of the International Searching Authority Dated Apr. 18, 2013, International Application No. PCT/US2012/047805", (Apr. 18, 2013).
"Partial International Search Report and Invitation to Pay Additional Fees by the International Searching Authority Dated Feb. 6, 2013, International Application No. PCT/US2012/047805", (Feb. 6, 2013).
U.S. Appl. No. 12/901,915, filed Oct. 11, 2010.
U.S. Appl. No. 13/181,437, filed Jul. 12, 2011.
U.S. Appl. No. 13/526,914, filed Jun. 19, 2012.
"Notice of Allowance Dated Jun. 5, 2014; U.S. Appl. No. 13/181,437", (Jun. 5, 2014).
"Office Action Dated Jul. 11, 2014; Chinese Patent Application No. 201080054641.5", (Jul. 11, 2014).
"Office Action Dated Jun. 23, 2014; U.S. Appl. No. 13/526,914", (Jun. 23, 2014).
"Office Action Dated Jan. 13, 2015; U.S. Appl. No. 13/526,914", (Jan. 13, 2015).
"Notice of Allowance Dated Jul. 29, 2015; U.S. Appl. No. 13/526,914", (Jul. 29, 2015).

* cited by examiner

DIGITAL HYDRAULIC OPPOSED FREE PISTON ENGINES AND METHODS

CROSS-REFERENCE TO RELATED APPLICATIONS

This application claims the benefit of U.S. Provisional Patent Application No. 61/513,363 filed Jul. 29, 2011.

BACKGROUND OF THE INVENTION

1. Field of the Invention

The present invention relates to the field of free piston engines and controllers therefore.

2. Prior Art

Internal combustion engines are useful devices for converting chemical energy to mechanical energy by combustion. Typical internal combustion engines convert the energy in petrochemical fuels such as gasoline or diesel fuel to rotary mechanical energy by using the pressure created by confined combustion to force a piston downward as the combustion gases expand and convert that motion into a rotary motion by use of a crankshaft. However, the use of the piston and crankshaft mechanism introduces many constraints in the operation of the engine that limit the amount of useful mechanical energy that can be extracted from the combustion process.

Free piston engines are linear, "crankless" internal combustion engines, in which the free piston motion is not controlled by a crankshaft but is determined by the interaction of forces from the combustion chamber gases, a rebound device and a load device. Hydraulic free piston engines couple the combustion free piston to a hydraulic cylinder that acts as both the load and rebound device using a hydraulic control system. This gives the unit operational flexibility.

As with any internal combustion engine, hydraulic free piston engines are subject to vibration created by reciprocating combustion free pistons. It would be desirable to use the operational flexibility of a hydraulic free piston engine to reduce the vibration caused by reciprocating combustion free pistons.

DETAILED DESCRIPTION OF THE PREFERRED EMBODIMENTS

In the description to follow, references are made to opposed free piston engines. The word opposed is meant to mean that both the mechanical layout of the engine includes opposed free pistons, and that the motion of the opposed free pistons is in opposite directions.

Disclosed herein are free piston type hydraulic internal combustion engines arranged and controlled to reduce vibration caused by the engine's reciprocating combustion free pistons. In the description to follow, disclosure of certain aspects of the invention with respect to one embodiment in general includes the possibility of use of those aspects in other embodiments as well.

Certain details that are not immediately relevant to the disclosed invention have been omitted to avoid obscuring the disclosure of the relevant aspects of the invention. It should be recognized that such additional details, as may be ascertained from the known art of free piston type hydraulic internal combustion engines, will be necessary or useful to fully practice the present invention. An exemplary hydraulic free piston engine which could be adapted to embody the present invention is described in U.S. patent application Ser. No. 12/901,915 (now published as U.S. Patent Application Publication No. 2011-0083643), which is incorporated in its entirety herein by reference.

The term "substantially" is used herein to mean within a reasonable tolerance that results from normal engineering practice.

It is conventional to describe aspects of the operation of an internal combustion engine with respect to the position of the crankshaft, e.g. top dead center (TDC). While a free piston engine does not have a crankshaft, reference will be made to terms such as "top dead center" to mean the free piston position as it would be described in an engine with a crankshaft, or as describing the limit of the free piston in one direction of travel, at least for the applicable free piston stroke. There is no requirement in the present invention that the top dead center and bottom dead center (BDC) positions of a free piston in a free piston engine be the same extreme positions for all strokes of the free piston, or for that matter, that the extreme positions be the same for all free pistons in a multiple free piston engine.

Figure 1:
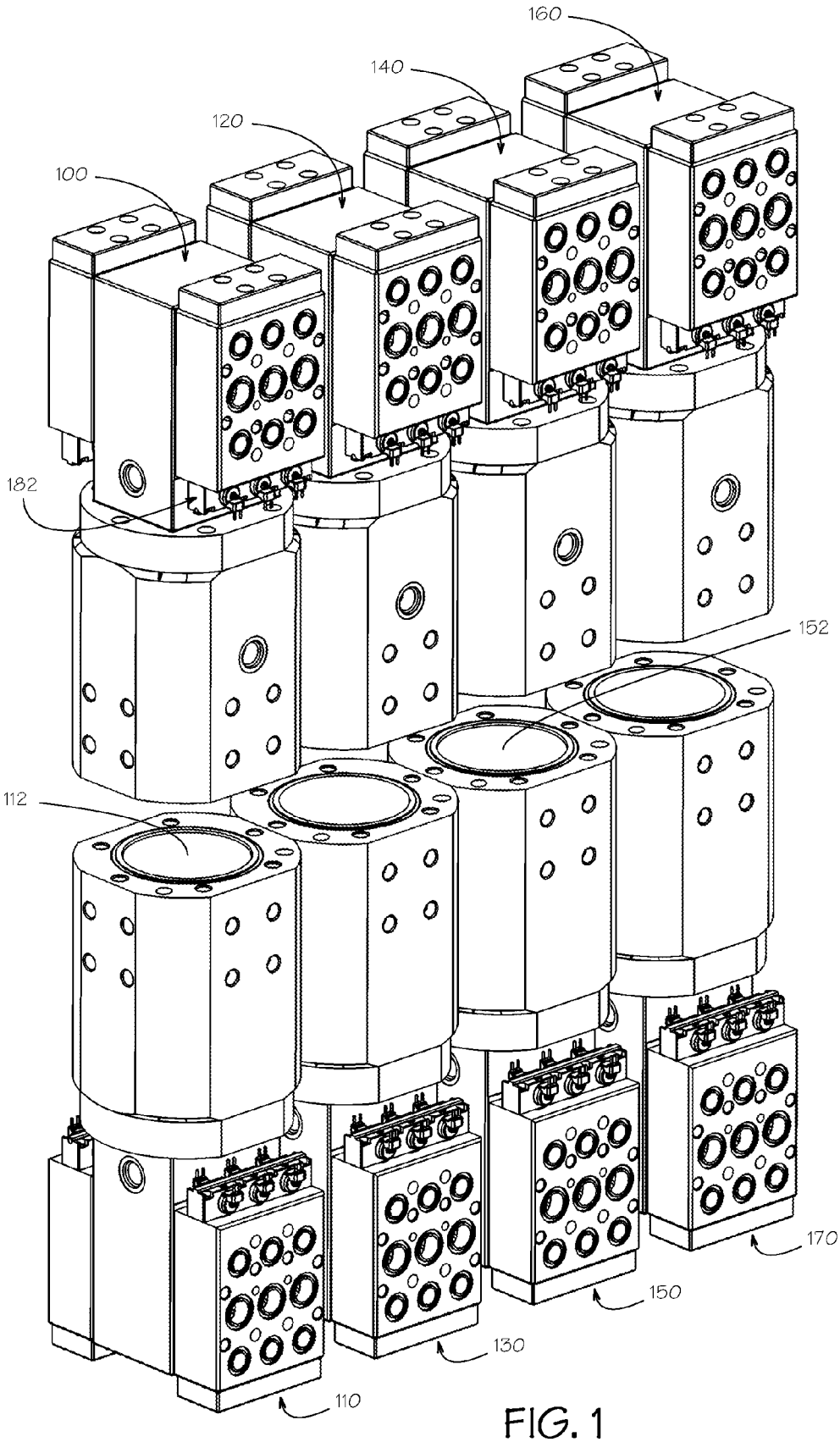
FIG. 1 is a pictorial view of a portion of a digital hydraulic opposed free piston engine in accordance with the present invention.

FIG. 1 is a pictorial view of a portion of a hydraulic free piston engine in accordance with the present invention. A cylinder head is not shown to allow the arrangement of the free pistons 112, 152 to be seen more clearly.

Figure 2:
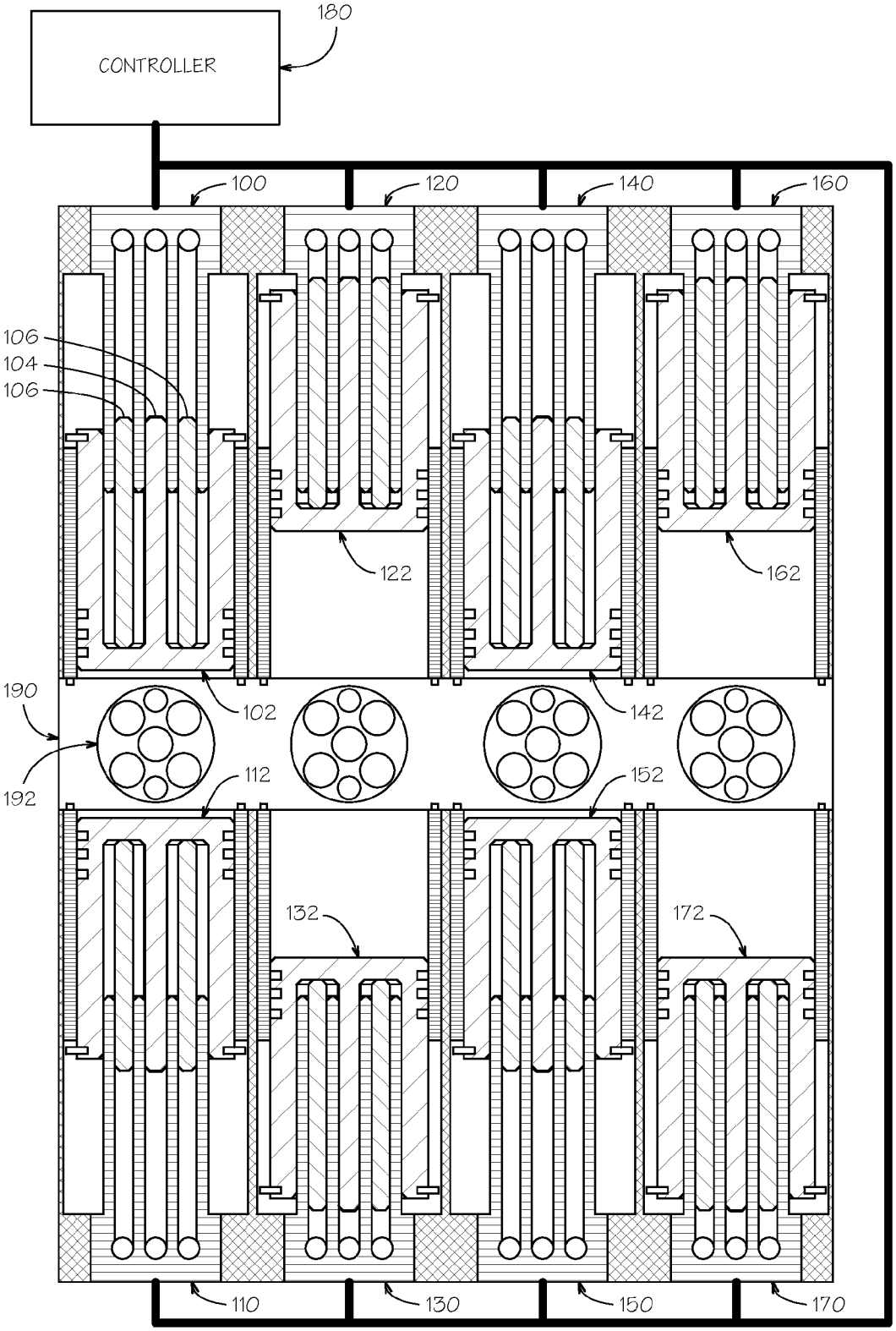
FIG. 2 is a schematic of the digital hydraulic opposed free piston engine of FIG. 1.

FIG. 2 is a schematic of the hydraulic free piston engine of FIG. 1. Certain aspects of the operation and control of the hydraulic free piston engine in accordance with the present invention may be more readily understood from the schematic representation.

The hydraulic free piston engine illustrated is an eight cylinder engine that is assembled from modular assemblies 100, 110, 120, 130, 140, 150, 160, 170 for each cylinder. It will be appreciated that hydraulic free piston engines that embody the invention can be made with a unified rather than a modular construction, with different numbers of cylinders, and in different configurations from the example illustrated.

Hydraulic free piston engines that embody the invention arrange the free pistons, cylinders, and associated mechanisms in pairs with axes of free piston motion for the two opposing free pistons being parallel. Preferably the axes of free piston motion for the two opposing free pistons are close together, and more preferably co-linear. In alternate embodiments, the axes of the two opposing free pistons could be offset, like in a V-8 engine, and engine balance approached like in a V-8 engine, though that is not preferred, as it does not take advantage of the potentially inherent near perfect balance of the opposed free piston engines.

In the embodiment illustrated, the paired free pistons are arranged such that the top dead center position of the free pistons is adjacent the midline of the engine. Thus the cylinder head 190 and combustion chambers (not shown) are arranged 180° from the orientation of a conventional opposed free piston engine where the crankshaft would occupy the space adjacent the midline of the engine. The cylinder head 190 includes various valves 192 such as intake and exhaust valves and possibly fuel injectors as may be required for an operational engine. Preferably the intake and exhaust valves are electronically controlled, hydraulically actuated valves, though other types of controllable valve actuation systems may be used if desired. Exemplary hydraulic valve actuation systems include U.S. Pat. Nos. 5,638,781, 5,713,316, 5,960,753, 5,970,956, 6,148,778, 6,173,685, 6,308,690, 6,360,728, 6,415,749, 6,557,506, 6,575,126, 6,739,293, 7,025,326, 7,032,574, 7,182,068, 7,341,028, 7,387,095, 7,568,633, and 7,730,858, and U.S. Patent Application Publication Nos. 2007/0113906, 2009/0199819 and 2010/0277265. These patents and patent applications disclose hydraulic valve actuation systems primarily intended for engine valves such as but not limited to intake and exhaust valves, and include, among other things, methods and apparatus for control of engine valve acceleration and deceleration at the limits of engine valve travel as well as variable valve lift.

The liquid fuel injectors may be intensifier type fuel injectors electronically controlled through spool valves of the general type disclosed in one or more of U.S. Pat. Nos. 5,460,329, 5,720,261, 5,829,396, 5,954,030, 6,005,763, 6,012,644, 6,085,991, 6,161,770, 6,257,499, 7,032,574, 7,108,200, 7,182,068, 7,412,969, 7,568,632, 7,568,633, 7,694,891, 7,717,359 and 8,196,844, and U.S. Patent Application Publication Nos. 2002/0017573, 2006/0192028, 2007/0007362, 2009/0199819, 2010/0012745, 2010/0186716, 2011/0163177 and 2012/0080110. These patents and patent applications disclose electronically controllable intensifier type fuel injectors having various configurations, and include direct needle control, variable intensification ratio, intensified fuel storage and various other features.

It will be appreciated that other hydraulic free piston engines that embody the invention can arrange the paired free pistons in a more conventional arrangement such that the top dead center positions of the free pistons are toward the outside of the engine. However, it is considered that the illustrated arrangement of the paired free pistons is preferred for effective construction of a hydraulic free piston engine according to the present invention.

As shown in FIG. 2, a controller 180 provides signals to control valves that direct hydraulic fluid to hydraulic plungers 104, 106 that move the free piston 102 or pump the hydraulic fluid to extract energy during the combustion stroke of the free piston. Using multiple plungers for each engine cylinder allows for matching or balancing the pressure force on top of the free pistons with the aggregate hydraulic pressure force on the bottom of the plungers through the entire engine cycle, thereby facilitating a controlled free piston/plunger velocity at any point of the combustion cycle, which in turn facilitates a high efficiency chemical to hydraulic energy conversion. A pressure sensor may be provided in the combustion chamber to provide an input to a controller that manages the free piston/plunger velocity, if desired, though monitoring the hydraulic control valve positions and free piston position, and from free piston position versus time, the free piston velocity and acceleration, provides essentially all information needed. An exemplary hydraulic free piston engine which uses multiple plungers is described in U.S. Patent Application Publication No. 2011/0083643 entitled "Hydraulic Internal Combustion Engines", which is incorporated in its entirety herein by reference.

In hydraulic free piston engines that embody the invention the controller 180 operates the free pistons so that the paired free pistons 102, 112 have substantially equal and opposite motions. In the illustrated embodiment, the paired free pistons are operated with the same cycles. For example as illustrated in FIG. 2, the leftmost pair of free pistons 102, 112 may be at TDC at the end of the compression stroke. The next pair of free pistons 122, 132 may be at BDC at the end of the intake stroke. The next pair of free pistons 142, 152 may be at TDC at the end of the exhaust stroke. The rightmost pair of free pistons 162, 172 may be at BDC at the end of the expansion or power stroke. For light loads on the engine output, some free piston pairs may be inactive (relatively motionless) while others may be operated at or very near their most efficient operating condition. This has great advantages in comparison to conventional crankshaft engines where all cylinders must be active (free pistons reciprocating) at all times, and typically at a speed that is controlled by the velocity of a vehicle, which can require the engine to operate far away from its most efficient operating point most of the time.

In other hydraulic free piston engines that embody the invention the paired free pistons may be operated such that each free piston is operating in a different phase while still having equal and opposite motions. For example referring to FIG. 2, the leftmost pair of free pistons 102, 112 may be at TDC with one free piston at the end of the compression stroke and the other at the end of the exhaust stroke. Similarly, the next pair of free pistons 122, 132 may be at BDC with one free piston at the end of the intake stroke and the other at the end of the expansion or power stroke. The remaining pairs of free pistons would operated similarly.

Operation of the hydraulic free piston engine with the paired free pistons each operating in a different phase allows the combustion cycle of each free piston to occur evenly over an operating cycle of the engine. For example, in the illustrated eight cylinder embodiment, operating the paired free pistons in different cycles allows the eight combustion strokes to occur at eight different times within each operating cycle of the engine. It will be appreciated that two pairs of the free pistons would be in different positions than illustrated in FIG. 2 in such an embodiment.

However, it will be appreciated that the paired free pistons may be more readily operated with equal and opposite motions when both free pistons are operated with the same phases and same cycles. There is less need to have a large number of evenly spaced power strokes in a hydraulic free piston engine because the storage of power in hydraulic form allows the cyclic fluctuations in power output from the internal combustion cycles to be more effectively evened out than in a conventional crankshaft engine. Also, in a hydraulic free piston engine with the paired free pistons each operating in a different phase, the free piston acceleration and deceleration forces balance, but the forces on the cylinder head caused by the rise in pressure in a combustion chamber do not, so that the engine will still have significant vibration. Accordingly such operation is not preferred.

Figure 3:
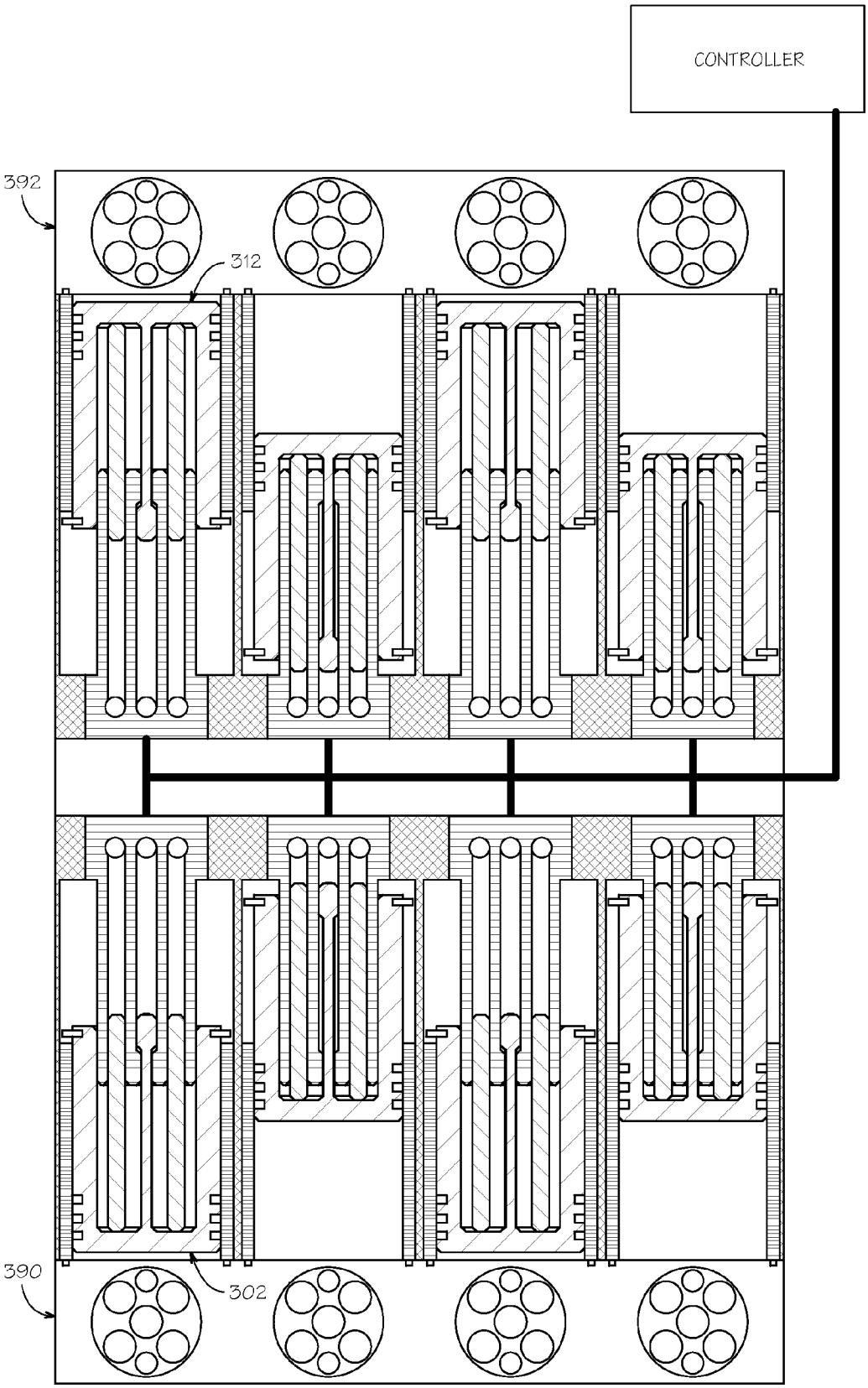
FIG. 3 is a schematic of another digital hydraulic opposed free piston engine that embodies the invention.

FIG. 2 shows a hydraulic free piston engine with the pairs of free pistons 102, 112 between the pairs of combustion chambers in the cylinder head 190. FIG. 3 shows another hydraulic free piston engine with the pairs of free pistons 302, 312 between the pairs of combustion chambers in the paired cylinder heads 390, 392. This embodiment is otherwise substantially similar to the embodiment shown in FIG. 2 and described above.

In any free piston engine the task is to control the free piston motion during each stroke of its operating cycle and to recover the energy output of the free piston in an efficient manner. Of particular importance are the top dead center and bottom dead center positions of the free piston and its velocity profile therebetween. In the free piston engines described in the U.S. published application hereinbefore referred to and the embodiments already described herein, the position of the free piston is sensed and from that information the top dead center and the bottom dead center positions of the free piston may be controlled, as well as the velocity profile of the free piston, throughout all strokes of the operating cycle. This is done by coupling the hydraulic free pistons to the high pressure rail or the low pressure rail in combinations to provide the desired force on the free piston for that particular stroke. By way of example, for a power stroke all hydraulic free pistons might initially be coupled to the high pressure rail to deliver high pressure hydraulic fluid thereto, with hydraulic free pistons being switched to the low pressure rail as the combustion chamber pressure drops and the free piston slows.

In an exemplary embodiment a central hydraulic free piston and six additional hydraulic free pistons distributed symmetrically around the center hydraulic free piston are used, as in the prior embodiments. The center free piston is a double acting plunger so that pressure on the back side of the free piston may be used for such purposes as powering an intake stroke. For a relative force of seven on the free piston toward the top dead center position all seven hydraulic cylinders would be coupled to the high pressure rail, for a relative force of six all except the center free piston would be coupled to the high pressure rail, for a relative force of five the center free piston and four of the surrounding symmetrically located free pistons would be coupled to the high pressure rail, etc. Note that if one uses all combinations during a power stroke, each hydraulic free piston will be switched between the high pressure and low pressure rails a number of times during that power stroke. While this may not be necessary, it does illustrate the point that one (or a pair) of hydraulic cylinders may need to be switched between the high and low rails (or accumulators) more than once during any one stroke of the free piston.

Figure 4:
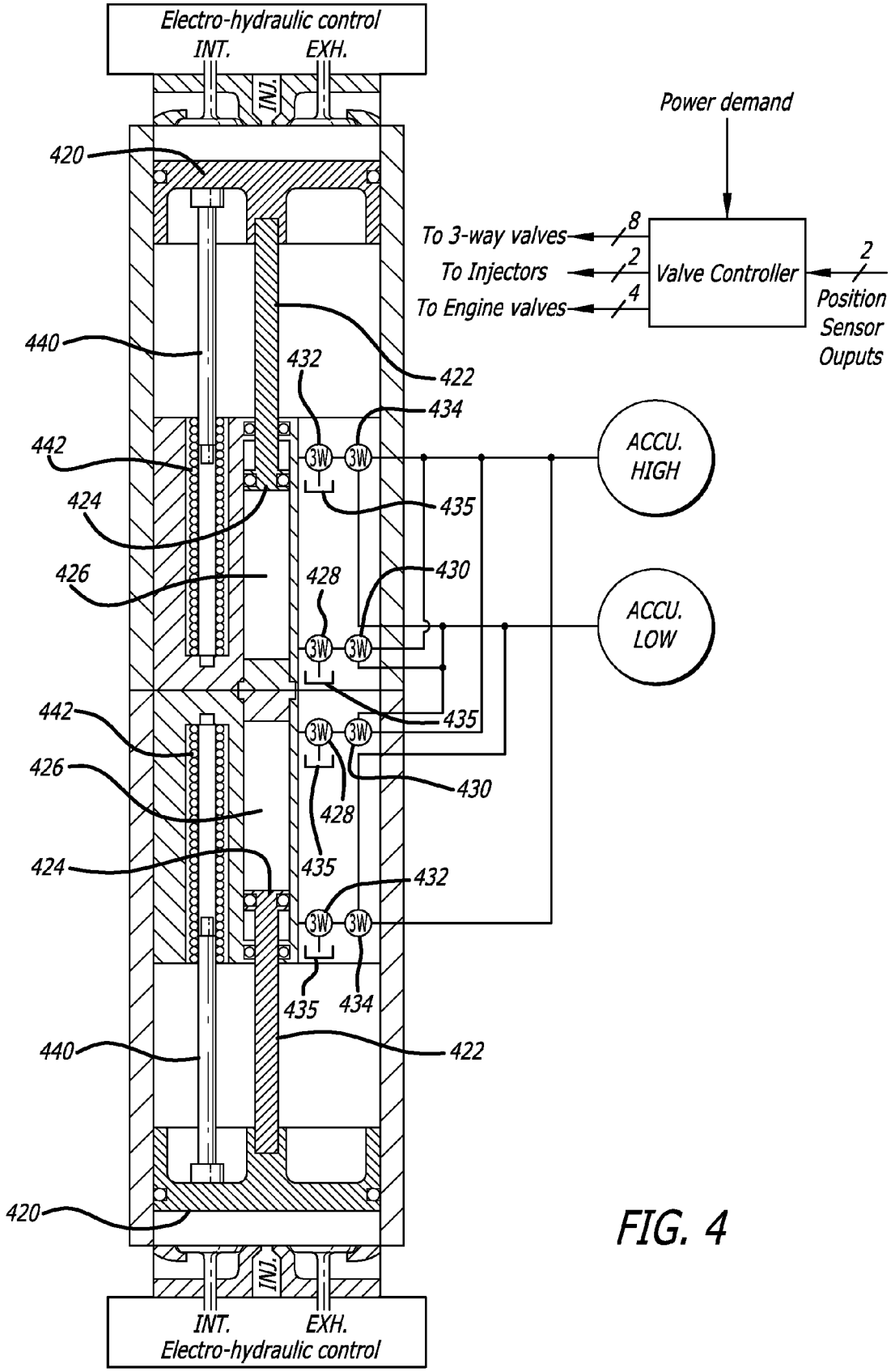
FIG. 4 is a schematic of still another digital hydraulic opposed free piston engine that embodies the invention.

In accordance with the present invention, the ability to operate the valves of the hydraulic free pistons in a time period which is much shorter than an individual stroke of the free piston makes feasible the modulation of the valving between coupling to the high pressure rail or accumulator and the low pressure rail or accumulator, and to the vent 435 (reservoir). As shown in FIG. 4, for each free piston of the free piston engine, the free piston 420 has a center free piston rod 422 coupled to a hydraulic free piston 424 in a hydraulic cylinder 426. As in the published application, the injectors INJ and the intake and exhaust valves INT and EXH would all be electronically controlled, hydraulically actuated as described in the published application and in the patents/published applications previously referred to.

The region on one side of the hydraulic free pistons 424 is coupled to first and second three-way valves 428 and 430 and the region on the other side of the hydraulic free pistons 424 is coupled to three-way hydraulic valves 432 and 434. In particular, the region in cylinders 426 on one side of free pistons 424 may be coupled to the reservoir (only shown in plurality schematically so as to not obscure the drawing) or to the three-way valves 430 by three-way valves 428, which in turn may direct the fluid flow to or from the high pressure accumulator ACCU HIGH or to or from the low pressure accumulator ACCU LOW. Similarly, the region in cylinders 426 on the other side of hydraulic free pistons 424 may be coupled to the reservoir or to three-way valves 434 by three-way valves 432, with three-way valves 434 coupling the flow from three-way valves 432 to or from the high pressure accumulator ACCU HIGH or the low pressure accumulator ACCU LOW. Note that the same valving is repeated for each pair of opposing free pistons in a multi-pair free piston engine, though it is only shown for one exemplary pair of opposing free pistons for clarity.

For relative values the reservoir may be, by way of example, open to the atmosphere, i.e., at atmospheric pressure, whereas the pressure in the accumulator ACCU LOW preferably will be significantly above atmospheric pressure, and most preferably at least high enough to backfill the hydraulic volumes on either side of the hydraulic free pistons 424 and the other hydraulic free pistons when the same are moving in a direction to require such backfilling. The pressure of the high pressure rail or accumulator ACCU HIGH will be quite high in comparison to the low pressure accumulator ACCU LOW, and may be, by way of example, on the order of a thousand bar.

It will be noted that the hydraulic area on one side of each of the hydraulic free pistons 424 is equal to the area of the respective hydraulic free piston 424 minus the cross-sectional area of the free piston rod 422. Thus the same pressure in the hydraulic region on one side of the hydraulic free pistons 424 will cause a substantially lower downward force on each free piston 420 than the upward force the same hydraulic pressure in hydraulic cylinders 426 on the other side of hydraulic free pistons 424 will cause. However less downward force will generally be needed to be exerted on the free pistons 420, as this is required generally only for an intake stroke, whereas the upward force required must be adequate for the compression stroke and of course adequate to absorb the hydraulic energy during the combustion or power stroke.

Typically the three-way valves 428, 430, 432 and 434 will be two-stage valves, the first stage being electronically controllable, with the second stage being hydraulically actuated by the first stage, though valves of other configurations may also be used, provided they have a sufficient operating speed.

In operation, when one side of the hydraulic free pistons 424 is not to be pressurized, the corresponding three-way valves 428 or 432 will couple the same to the reservoir. For the side of the hydraulic free pistons 424 to be pressurized, the three-way valves 428 or 432 will couple the corresponding hydraulic region to three-way valves 430 or 434, which will alternate between coupling flow to the high pressure accumulator ACCU HIGH and the low pressure accumulator ACCU LOW at a high speed and with varying timing so that the average force on the hydraulic free piston 424 during the corresponding time interval approximates the desired force. For this purpose, it is particularly important that the three-way valves 430 and 434 are carefully designed to avoid a momentary hydraulic lock when switching between their two valve positions, yet at the same time avoid any substantial direct coupling between the high pressure accumulator and the low pressure accumulator. The hydraulic lock or a near hydraulic lock consideration is also important for the three-way valves 428 and 432, though those valves would normally switch at or around the top dead center and bottom dead center positions of the free piston where velocities and flow rates are not substantial, though the short circuit possibilities between the accumulators or either accumulator and the vent 435 is still a particular concern.

For free piston position sensing, magnetic steel plungers 440 are used together with coils 442 which are excited with a relatively high frequency AC signal. The impedance of the coils will vary with the position of the respective magnetic plunger 440. While the variation in impedance with plunger position as measured may not be linear and/or the circuitry for sensing the impedance may not be linear, a calibration curve may readily be applied to linearize the output signal with free piston position.

Note that in a free piston engine of the type being described, any given opposing cylinders may go from an off state wherein the free piston 420 is at a fixed position to a full power state wherein the free piston engine cylinder is operating at maximum power within one or two strokes of the free pistons 420. Further, there typically will be a most efficient operating condition for a free piston in a free piston engine which may be expressed primarily in terms of free piston position and velocity profiles. Accordingly by way of example, under light load conditions one or more cylinders may be entirely turned off, or alternatively, all cylinders may be operated though with a pause between operating cycles, such as a pause at the bottom dead center free piston position after an intake stroke before later resuming operation, or the top dead center position after an exhaust stroke. Ignition could be sensed by a pressure sensor extending into each combustion chamber, though ignition may be more easily sensed by sensing pressures or pressure changes in the hydraulic fluid in the region below the hydraulic free pistons 424, and cycle to cycle adjustments made to maintain ignition in each opposing combustion chamber at the desired free piston positions. Note that in a free piston engine, the free piston may continue a compression stroke until ignition occurs, so that as long as fuel is available, the cycle to cycle adjustments are in effect controlling the free piston position when ignition occurs, effectively controlling what is being called the top dead center free piston position.

The free piston engine may be configured and operated as a conventional four stroke compression ignition engine, a two stroke compression ignition engine or in accordance with other operating cycles, as desired. Compression ignition at or near a free piston top dead center position may be assured by cycle to cycle adjustment in the operation of the intake and exhaust valves INT and EXH, and equal power derived from opposing free pistons by control of the amount of fuel present in each. In a free piston engine, a compression stroke may be continued, provided fuel is available, until ignition occurs, so the cycle to cycle adjustment is essentially controlling the top dead center free piston position at which compression ignition occurs. Ignition may be sensed by putting a pressure sensor in each free piston combustion chamber, though a simpler and less expensive way of sensing ignition is to sense the rapid rise in pressures in the hydraulic fluid under hydraulic free pistons 424. Such sensing may also be used to balance the pressure profiles during the combustion stroke by adjusting the ratio of the amount of fuel injection or fuel intake in the two opposing cylinders, cycle to cycle.

As pointed out before, the ability to operate the valves (428, 430, 432 and 434 in the exemplary embodiment) in a time period which is much shorter than an individual stroke of the free pistons makes feasible the modulation of the valving between coupling to the high pressure rail or accumulator and the low pressure rail or accumulator, and to the vent 435 (reservoir) when the hydraulic fluid is being discharged to the vent 435. Preferably each free piston will follow predetermined position and velocity profiles, either fixed for all operation of the engine or dependent on the specific engine operating conditions. The position profiles particularly define the top dead center and bottom dead center free piston positions, with the velocity profiles particularly defining the preferred free piston velocities between these two end positions.

In theory, one could modulate the operation of the valves at a high frequency to accurately hold the free piston velocities to the desired velocity profile. However there are some losses associated with the actuation of the valves that limits the number of actuations that are practical per free piston stroke. Aside from the energy required to operate the valves, it is particularly important that hydraulic fluid flow never be blocked when the respective free piston is moving. This means for instance that when switching between the high pressure accumulator and the low pressure accumulator, one must allow some momentary coupling together of the high and low pressure accumulators. It is for this reason that it is preferred to use three-way valves for valves 428, 430, 432 and 434 rather than two, two-way valves for each, as a three-way valve can be designed to have a momentary coupling that is adequate but not excessive, and is not subject to problems of the possible difference in speed of operation of two two-way valves. Consequently to avoid excessive losses due to valve actuation, the control system should allow significant deviation from the intended or ideal velocity profile to limit the amount of valve actuation losses commensurate with the added losses that large excursions from the intended velocity profile will cause. In that regard, an ideal velocity profile can be easily experimentally established, and in fact different profiles might be used dependent on whether maximum efficiency or maximum power is desired.

Also shown in FIG. 4 is a basic control system for each pair of opposing free pistons 420. In particular, a valve controller is provided in this embodiment for each pair of opposing free pistons 420, with a master controller (not shown) providing a power demand signal to the valve controller of each pair of free pistons. Also provided to the valve controller are the two position sensor outputs so that the valve controller can control the top dead center and bottom dead center positions of the free pistons and the velocity profiles between these two positions. Not shown in FIG. 4, if used, are the pressure sensors for sensing ignition and effectively sensing the pressure profiles in each combustion chamber so as to balance the same for better vibration cancellation. As stated before, these pressure sensors may be configured to directly sense the pressure in the combustion chambers, or alternatively, to effectively sense the pressures in chambers 426 to provide an indirect detection of ignition and a indirect measure of the peak pressures in each combustion chamber. Of course the valve controller would control the eight three-way valves used for a pair of free pistons 420 and would also control the injectors for the two combustion chambers and the engine valves comprising at least one intake valve INT and one exhaust valve EXH for each combustion chamber. In a free piston engine having a plurality of pairs of free pistons, a master controller could be used to provide the power command signal to the valve controllers for each opposing pair of free pistons, which may include operating some pairs of free pistons at their maximum efficiency while stopping at least one other pair of opposing free pistons from any operation, at least temporarily, or alternatively operating all pairs of free pistons in a multi-pair free piston engine for maximum power, which may well be a different operating point than the maximum efficiency point. By way of example, the maximum power output might be achieved with higher free piston velocities with the increment in increased power being reduced, but not eliminated, by greater hydraulic losses.

Thus for control of the free piston engines such as that of FIG. 4, the same may be operated in a conventional four stroke diesel cycle with ignition occurring on injection of the liquid fuel at or near top dead center position of the free pistons after the temperature of compression is adequate to cause ignition. Alternatively, all fuel that is to be injected could be injected early in the compression strokes, with the free piston position at the time of ignition being controlled primarily by control of the intake valve INT. Of course, other operating cycles may be used if desired, such as a two stroke cycle.

The balance in pressure rise between two opposing free pistons can of course be controlled by controlling the relative balance in the amount of fuel injected in each combustion chamber. The free piston velocity profiles are controlled by three-way valves 428, 430, 432 and 434, as is the bottom dead center position. Of course one of the features of a free piston engine such as that disclosed herein is not only its relative smoothness in operation but also the fact that the velocity profiles for the exhaust and intake strokes do not need to be identical to the velocity profiles for the compression and power strokes (if operating as a four stroke cycle engine), and of course for fuels which are difficult to obtain compression ignition, the compression ratio limit in a free piston engine such as that disclosed herein can be as high as needed for compression ignition, and of course the pressure and temperature rise upon ignition will be at least somewhat limited in that the initial motion of the free piston to increase combustion chamber volume after ignition is not constrained by the presence of a crankshaft which must move through a substantial angle before any significant motion of the free piston occurs around top dead center.

It should be noted that the foregoing comments regarding FIG. 4 are also generally applicable to the embodiments of FIG. 1.

If the axes of free piston motion for the two free pistons in any opposed free piston free piston engine are close together, only a small amount of net rotational force will be generated by the motion of the paired free pistons. In the preferred arrangement of co-linear axes of free piston motion for the two free pistons, the forces generated by the motion of the paired free pistons will substantially cancel each other. Thus the arrangement and control of hydraulic free piston engines with paired free pistons having equal and opposite motions according to the invention will substantially eliminate vibration generated by the free piston motion.

Thus the present invention has a number of aspects, which aspects may be practiced alone or in various combinations or sub-combinations, as desired. While preferred embodiments of the present invention have been disclosed and described herein for purposes of illustration and not for purposes of limitation, it will be understood by those skilled in the art that various changes in form and detail may be made therein without departing from the spirit and scope of the invention.

What is claimed is:

1. An internal combustion engine comprising:

a pair of free pistons in a pair of cylinders defining a combustion chamber above each free piston, the pair of free pistons arranged to move within the pair of cylinders with parallel axes of free piston motion and not being physically connected to each other and each not being physically connected to any other free piston to allow the two free pistons to move in opposite directions at the same time;

at least one hydraulic plunger under each free piston, each hydraulic plunger in a respective hydraulic cylinder, the hydraulic cylinders being coupled to electronically controlled hydraulic cylinder valving; and a controller, the controller controlling the electronically controlled hydraulic cylinder valving to control the pair of free pistons to have substantially equal and opposite motions at the same time.

2. The internal combustion engine of claim 1 wherein the pair of combustion chambers are between the pair of free pistons.

3. The internal combustion engine of claim 1 wherein the pair of free pistons are between the pair of combustion chambers.

4. The internal combustion engine of claim 1 wherein the pair of free pistons are further arranged to move within the pair of cylinders with co-linear axes of free piston motion.

5. The internal combustion engine of claim 4 wherein one hydraulic plunger under each free piston is located on the axis of free piston motion and is a double acting free piston for encouraging the respective free piston in either of two opposite directions to execute at least a compression stroke and a power stroke responsive to pressure of hydraulic fluid on the double acting plunger.

6. The internal combustion engine of claim 5 wherein the free piston motions are controlled by modulating the pressures on the double acting plunger by modulating the hydraulic cylinder valving to couple the double acting plunger to controllably couple each side of the double acting plunger to a high pressure accumulator, a low pressure accumulator and a vent, the vent being at a lower pressure than the low pressure accumulator and the low pressure accumulator being at a lower pressure than the high pressure accumulator.

7. The internal combustion engine of claim 5 wherein a number of additional plungers are disposed symmetrically around the double acting plunger, and wherein the motion of the respective free piston is controlled at least in part by controlling the hydraulic cylinder valving to couple symmetrically disposed pairs of plungers to controllably couple the symmetrical pairs of plungers to a high pressure accumulator, a low pressure accumulator and a vent, the vent being at a lower pressure than the low pressure accumulator and the low pressure accumulator being at a lower pressure than the high pressure accumulator.

8. The internal combustion engine of claim 1 wherein the pair of free pistons are operated with the same cycles of a combustion process.

9. The internal combustion engine of claim 1 wherein the pair of free pistons are operated with different cycles of a combustion process.

10. The internal combustion engine of claim 1 wherein each combustion chamber further comprises at least one electronically controlled intake valve, at least one electronically controlled exhaust valve and at least one electronically controlled fuel injector.

11. An internal combustion engine comprising:

a pair of free pistons in a pair of cylinders defining a combustion chamber above each free piston, the pair of free pistons arranged to move within the pair of cylinders along the same axis and not being physically connected to each other and each not being physically connected to any other free piston to allow the two free pistons to move in opposite directions at the same time;

at least one hydraulic plunger under each free piston, each hydraulic plunger in a respective hydraulic cylinder, the hydraulic cylinders being coupled to electronically controlled hydraulic cylinder valving; and a controller, the controller controlling the electronically controlled hydraulic cylinder valving to control the pair of free pistons to have substantially equal and opposite motions at the same time for each stroke of the of free pistons.

12. The internal combustion engine of claim 11 wherein the pair of combustion chambers are between the pair of free pistons.

13. The internal combustion engine of claim 11 wherein the pair of free pistons are between the pair of combustion chambers.

14. The internal combustion engine of claim 11 wherein the pair of free pistons are operated with the same cycles of a combustion process.

15. The internal combustion engine of claim 11 wherein each combustion chamber further comprises at least one electronically controlled intake valve, at least one electronically controlled exhaust valve and at least one electronically controlled fuel injector.

16. The internal combustion engine of claim 11 wherein one hydraulic plunger under each free piston is located on the axis of free piston motion and is coupled to the respective free piston, and is a double acting free piston for encouraging the respective free piston in either of two opposite directions to execute at least a compression stroke and a power stroke responsive to pressure of hydraulic fluid on the double acting plunger.

17. The internal combustion engine of claim 16 wherein the free piston motions are controlled by modulating the pressures on the double acting plunger by modulating the hydraulic cylinder valving to couple the double acting plunger to controllably couple each side of the double acting plunger to a high pressure accumulator, a low pressure accumulator and a vent, the vent being at a lower pressure than the low pressure accumulator and the low pressure accumulator being at a lower pressure than the high pressure accumulator.

18. The internal combustion engine of claim 16 wherein a number of additional plungers are disposed symmetrically around the double acting plunger, and wherein the motion of the respective free piston is controlled at least in part by controlling the hydraulic cylinder valving to couple symmetrically disposed pairs of plungers to controllably couple the symmetrical pairs of plungers to a high pressure accumulator, a low pressure accumulator and a vent, the vent being at a lower pressure than the low pressure accumulator and the low pressure accumulator being at a lower pressure than the high pressure accumulator.

19. A method of operating a free piston engine comprising:

providing a pair of free pistons in coaxial cylinders, the free pistons not being physically connected to each other and each not being physically connected to any other free piston;

operating the free pistons in a compression ignition combustion cycle in equal and opposite directions at the same time;

sensing compression ignition in each cylinder and making adjustments in engine operating conditions combustion cycle to combustion cycle for differences in ignition times and free piston positions at the time of ignition; and sensing pressure in each cylinder after compression ignition and making adjustments, combustion cycle to combustion cycle, in the ratio of fuel to balance the pressure profiles during the combustion stroke by adjusting the ratio of an amount of fuel injection or fuel intake in the two opposing cylinders, cycle to cycle.

20. The method of claim 19 further comprising:

providing a high pressure accumulator, a low pressure accumulator and a vent, the high pressure accumulator having a higher pressure than the low pressure accumulator and the low pressure accumulator having a higher pressure than the vent;

providing at least one hydraulic plunger in the form of a double sided piston coupled to each of the pair free pistons; and, controllably coupling the double sided piston to the high pressure accumulator, the low pressure accumulator and the vent to control the motion of the free pistons.

21. The method of claim 20 further comprising sensing the positions of each of the free pistons to control top dead center positions and bottom dead center positions of each free piston.

22. The method of claim 21 wherein controlling the motion of the free pistons comprises controlling the velocity profiles of the free pistons.

* * * * *